US006216519B1

(12) United States Patent
Hartung et al.

(10) Patent No.: US 6,216,519 B1
(45) Date of Patent: Apr. 17, 2001

(54) ROLL FOR A ROLL STAND

(75) Inventors: Hans Georg Hartung, Pulheim; Ludwig Weingarten, Düsseldorf, both of (DE)

(73) Assignee: SMS Schloemann-Siemag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 09/262,612

(22) Filed: Mar. 4, 1999

(30) Foreign Application Priority Data

Mar. 20, 1998 (DE) ..... 198 12 263

(51) Int. Cl.[7] ..... B21B 31/07
(52) U.S. Cl. ..... 72/247; 72/243.6
(58) Field of Search ..... 72/247, 241.2, 72/241.8, 241.4, 242.2, 242.4, 243.2, 243.4, 243.6

(56) References Cited

U.S. PATENT DOCUMENTS 4,407,151 10/1983 Gronbech .
4,683,744 * 8/1987 Ginzburg et al. ..... 72/247
4,781,051 * 11/1988 Schultes et al. ..... 72/247
4,955,221 * 9/1990 Feldmann et al. ..... 72/247

FOREIGN PATENT DOCUMENTS 3038865 12/1982 (DE) .
9703768 2/1997 (WO) .

* cited by examiner

*Primary Examiner*—Rodney A. Butler
(74) *Attorney, Agent, or Firm*—Friedrich Kueffner

(57) ABSTRACT

A roll for a roll stand including a roll shaft with at least one roll ring mounted on the roll shaft, wherein the roll shaft is axially displaceable. The roll stand for rolling a metal strip may be, for example, a two-high stand, a four-high stand or six-high stand. The surfaces of at least two of the inner roll components enclosed by an outer roll ring have contours which are curved in the axial direction, wherein the curved contours are turned relative to each other by 180°.

9 Claims, 4 Drawing Sheets

ROLL FOR A ROLL STAND

BACKGROUND OF THE INVENTION

1. Field of the Invention

The present invention relates to a roll for a roll stand including a roll shaft with at least one roll ring mounted on the roll shaft, wherein the roll shaft is axially displaceable. The roll stand for rolling a metal strip may be, for example, a two-high stand, a four-high stand or six-high stand.

2. Description of the Related Art

When manufacturing a metal strip, the thickness and cross-section thereof are determined by the roll gap. The precise contour of the roll gap adjusted under load is dependent on various variables. These variables are the wear of the work rolls, the elastic deformation of the roll systems, the roll camber, as well as the thermal crown which is due to a non-uniform heating of the roll body between the center of the body and the edge of the body. Without making corrections by means of adjusting units, the crown of the work rolls continuously increases with increasing throughput of the rolling stock, and because of the thermal crown which changes in this manner the roll contour increasingly deviates from the desired contour, for example, a parabola.

In order to influence the deviation of the actual profile shape from the desired profile shape of the rolled strip during the rolling procedure, it is known in the art to construct single-piece work rolls or pairs of intermediate rolls in such a way that the roll body has a curved contour which deviates from a straight line extending parallel to the roll shaft, wherein this curved contour extends over the entire length of the roll body, and wherein the rolls are axially displaceable in opposite directions as disclosed in DE 30 38 865 C1. Consequently, the change of the thermal crown and the wear of the work rolls is compensated in such a way that the thermal crown is equal to the desired contour. In this connection, the roll gap is influenced by the curved contour of the roll bodies together with a relative displacement of the cooperating rolls.

In a roll of the above-described type disclosed in U.S. Pat. No. 4,407,151, the support load is influenced by an axial displacement of the roll shaft or support shaft.

Moreover, various systems are known in the art in which the crown of a roll, and also the support width in individual cases when the roll is used as a back-up roll, can be changed by means of hydraulic measures. In these systems, such as Nipco roll, VC roll, Sumitomo roll, inflatable roll, etc., the external shape or crown of the rolls and possibly also the resiliency of the roll relative to external loads along the roll body are changed by means of oil pressure cushions and/or hydraulically actuated support shoes and, thus, are adjusted to the rolling conditions.

The above-described embodiments have the disadvantage that the hydraulic system is complicated and, therefore, not very reliable in its operation. In addition, since the tightness of a roll is usually not sufficient, a contamination of the rolling oil or rolling emulsion by the hydraulic oil cannot be prevented.

SUMMARY OF THE INVENTION

Therefore, it is the primary object of the present invention to provide a roll of the above-described type in which the adjustment of the roll gap during the rolling process can be simplified and can be carried out more precisely as compared to conventional measures, and in which the possibilities of adjusting the individual roll pairs is multiplied.

In accordance with the present invention, the surfaces of at least two of the inner roll components enclosed by an outer roll ring have contours which are curved in the axial direction, wherein the curved contours are turned relative to each other by 180°.

Except for being turned relative to each other by 180°, the mathematical functions describing the surface contours of these two inner components in the axial direction are equal. Although it is recommended that surfaces which face each other are contoured in accordance with the present invention, the contours of the at least two inner components in questions do not have to be in direct contact, but they can also be separated from each other by one or more roll rings or shells, even if the latter are also contoured themselves; the function of the pair of components under consideration is only slightly affected as a result.

The actual shape can be adjusted much more precisely because the multiple-component construction of the roll according to the present invention provides already within a single roll a variety of possibilities for changing the outer contour of the roll in order to adjust the desired roll gap. This variety is further increased if, in accordance with a proposal of the present invention, not only the roll shaft but also the roll ring or roll rings are axially displaceable. Another advantage of the roll according to the present invention is the fact that the outer surface, i.e., the surface which is subjected to the greatest wear, has an axis-parallel or cylindrical shape. Consequently, when regrinding this surface, it is then not necessary to take into consideration any contours, as is the case in single-piece curved contoured rolls in which it is necessary to precisely take into consideration the oppositely directed surface contours when processing the respective pairs of rolls. On the other hand, in the roll according to the present invention which has an internal curvature, a simple cylindrically-shaped grinding is sufficient.

Accordingly, advantageous further developments of the invention provide that the roll shaft and the inner roll ring or the outer surface of the inner roll ring and the inner surface of an outer roll ring have a curved contour, wherein the roll rings can be constructed as single pieces or of several parts. An outer roll ring arranged on the internally contoured inner roll ring always has on the outer surface thereof a cylindrical shape.

In accordance with another proposal of the present invention, the curved contoured surfaces which face each other are constructed so as to engage with each other in a positively engaging manner, wherein the surfaces can be provided with a thread. This makes it possible to take into consideration the fact that it may be necessary under certain circumstances to transmit torques between the individual components of the roll which exceed the maximum torque which can be transmitted solely by frictional engagement.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
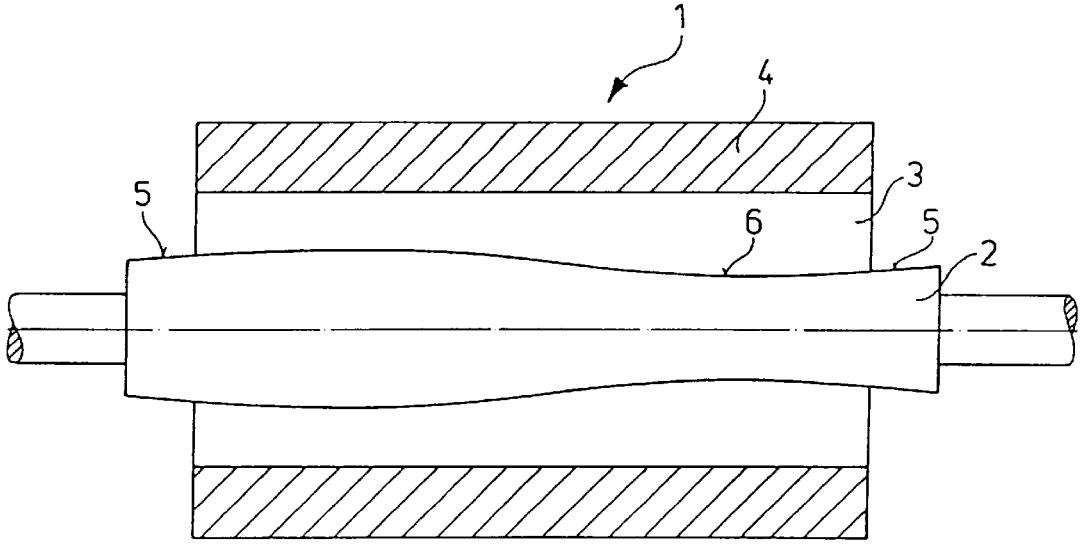
FIG. 1 is a sectional view of a multiple-part or multiple-shell roll with internal curvature, i.e., a paired curved contour of the roll shaft and the inner roll ring in the axial direction.

FIG. 1 of the drawing shows a roll 1 which can be used as a work roll or as an intermediate roll. The roll 1 is composed of a roll shaft 2 with an inner roll ring 3 mounted on the roll shaft 2 and an outer roll ring 4 concentrically surrounding the inner roll ring 3. The surface 5 of the roll shaft 2 as well as the inner surface 6 of the inner roll ring 3 have a contour which is curved in the axial direction, wherein the surface contours of these components are turned by 180° relative to each other. On the other hand, the outer roll ring 4 has a shape which is cylindrical, i.e., non-contoured.

Figure 2:
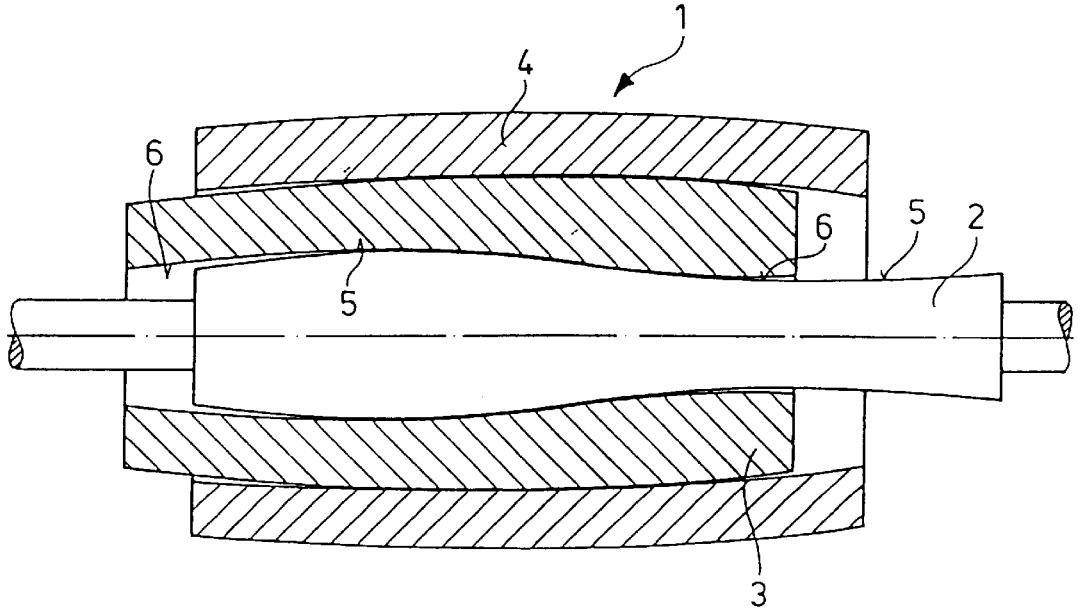
FIG. 2 is a sectional view showing the roll of FIG. 1 with the inner roll ring being displaced toward the left.

For effecting a variable adjustment of the roll gap, the roll shaft 2 as well as the inner roll ring 3 are axially displaceable; FIG. 2 shows a position of operation in which the inner roll ring 3 is moved toward the left and the roll shaft 2 is moved toward the right. By having the contours described by the same function but turned by 180° and displaced by the same distance in opposite directions, an internal force is produced which in this example results in a symmetrical barrel-shaped expansion of the outer roll ring or shell 4 and, thus, of the entire roll, and in symmetrically changed pressure distributions between the components of the roll as compared to the initial state.

In addition to changing the external shape which corresponds to a change of the crown of the roll 1, it is possible by using suitable contours to achieve symmetrical separations of the roll rings 3 and 4 from each other in certain areas along the roll body. In these areas of "gaping" roll rings, the roll stiffness drops significantly. Particularly when rolling strips which are significantly narrower than the length of the roll body, this results in a substantial advantage because the adjustment of the support width to the load width (which equals strip width) reduces the total bending of the work rolls in the strip area which is decisive for the flatness of the strip.

Figure 3:
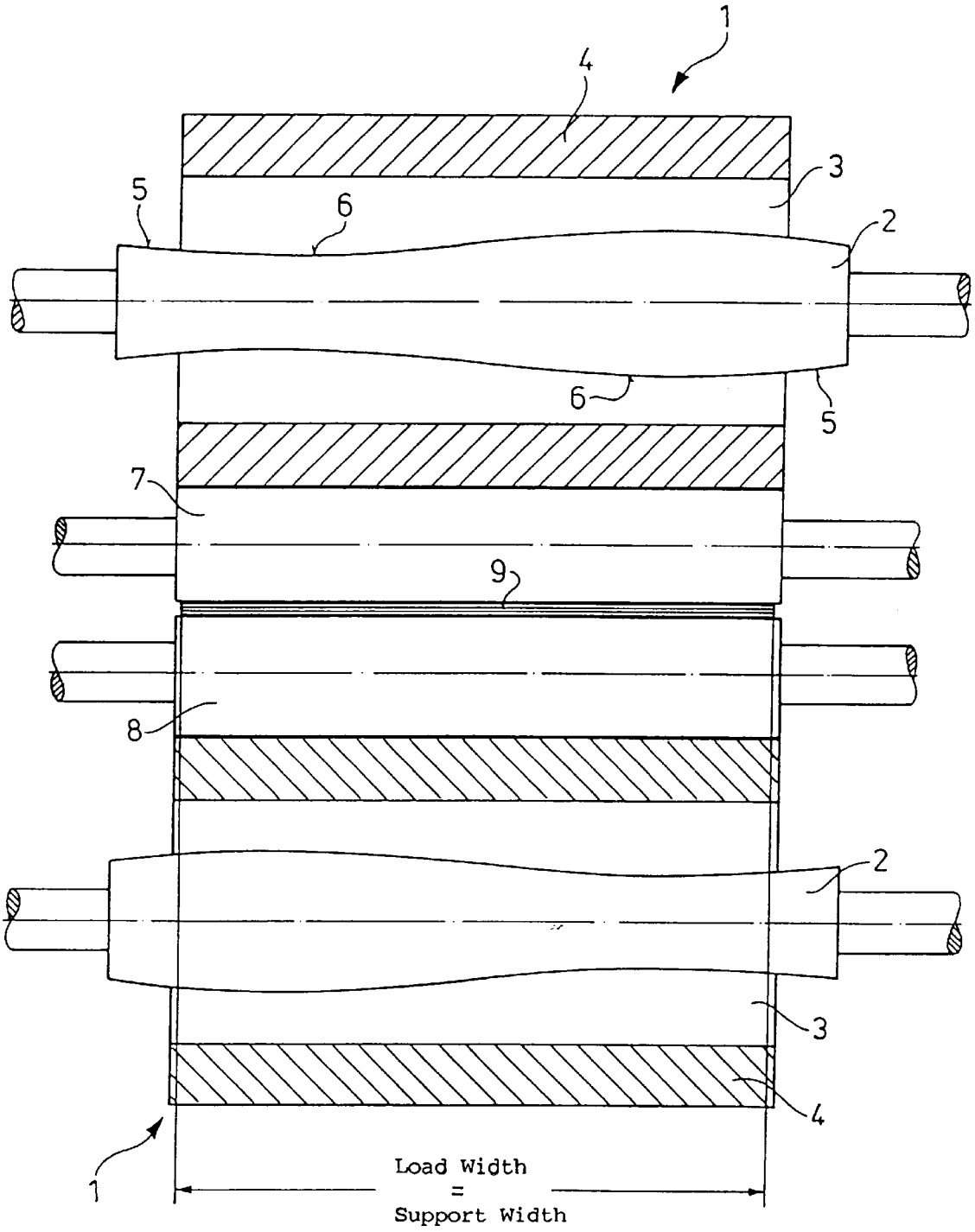
FIG. 3 is a sectional view of a four-high roll arrangement with back-up rolls having an internal curvature in accordance with FIG. 1.
Figure 4:
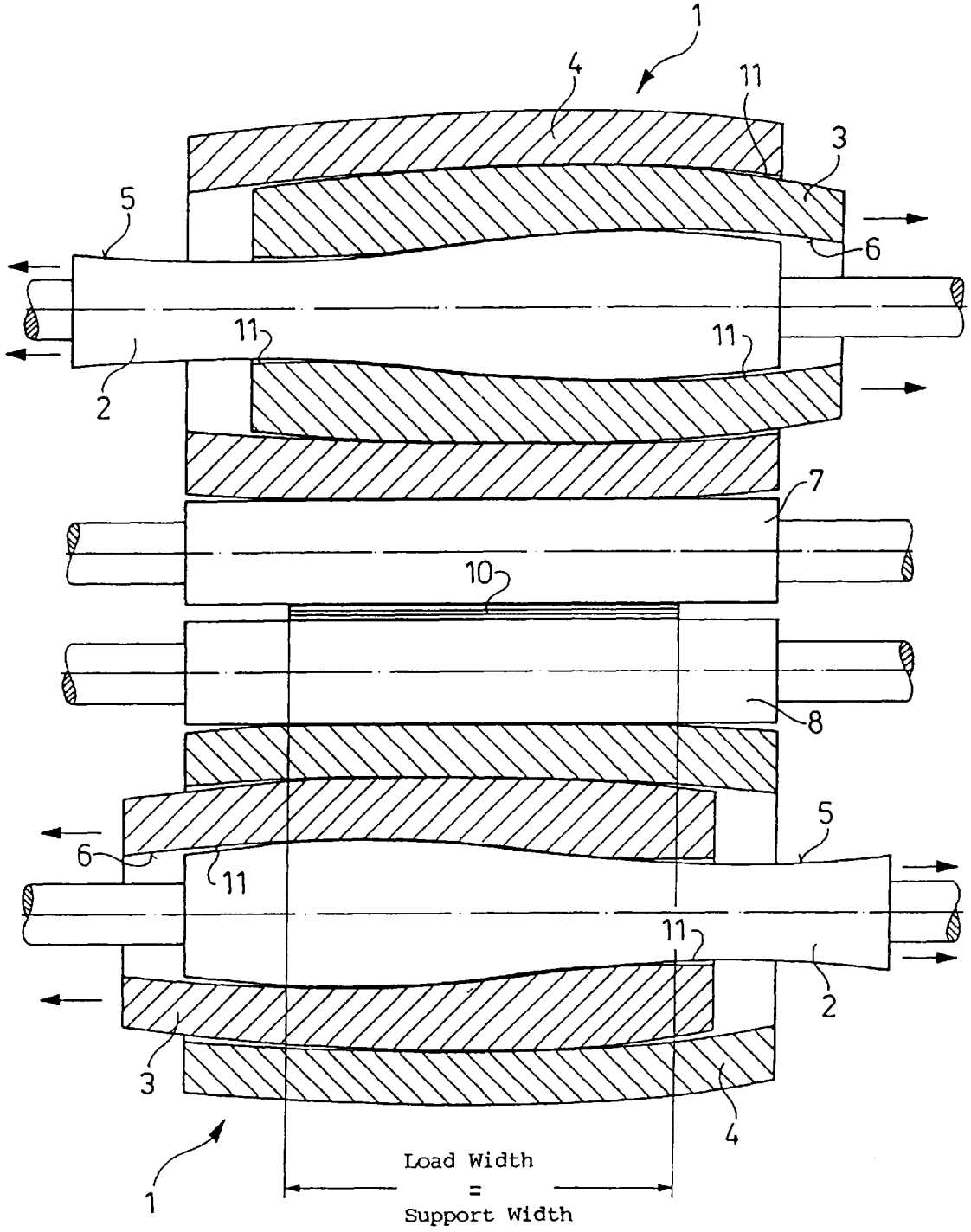
FIG. 4 is a sectional view of the roll arrangement according to FIG. 3 with the roll shafts and the inner roll rings being axially displaced.

FIGS. 3 and 4 show examples of the use of the roll 1 as a back-up roll for single-part work rolls 7, 8 with different widths of the strip to be rolled; FIG. 3 shows strip 9 and FIG. 4 shows strip 10. In the case of FIG. 3, the load width or strip width corresponds to the support width by the rolls 1; both the inner roll rings 3 and the roll shafts 2 are not axially displaced. In this situation, a contact takes place over the entire axial extension of the curved contour corresponding to the length of the inner roll rings between the curved surfaces 5 and 6 of the roll shaft 2 and the inner roll ring 3, respectively. On the other hand, FIG. 4 shows a rolling situation which occurs frequently in practice in which a multiple-part back-up roll 1 having internal complimentary curved surfaces is during rolling of a strip 10 having a smaller width in contact with the work roll 7 or 8 to be supported even beyond the strip edge. The contours of the surfaces 5 and 6 are selected in such a way that, when the inner roll ring 3 and the roll shaft 2 are moved in axially opposite directions in accordance with the arrows pointing toward the left and to the right as shown in FIG. 4, this adjustment results in the already previously mentioned partial separation 11 in the interior of the roll 1 and, thus, in an increased resiliency of the roll at these locations; this has the result that, because of the interaction with the other roll, the load is correspondingly low and, thus, practically does not contribute to the support. Consequently, the relevant support width is limited to the essentially gapless portion which corresponds to the width of the rolled strip 10. The increased roll resiliency in the areas next to the rolled strip 10 results in a reduction of the strip edge sharpening.

Figure 5:
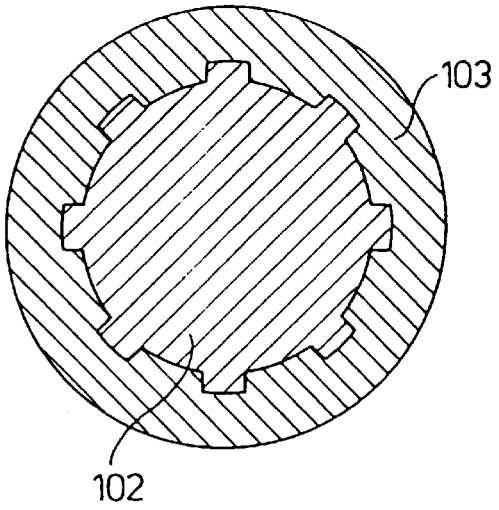
FIG. 5 is a cross-sectional view of a support shaft in positive engagement with a roll ring.
Figure 6:
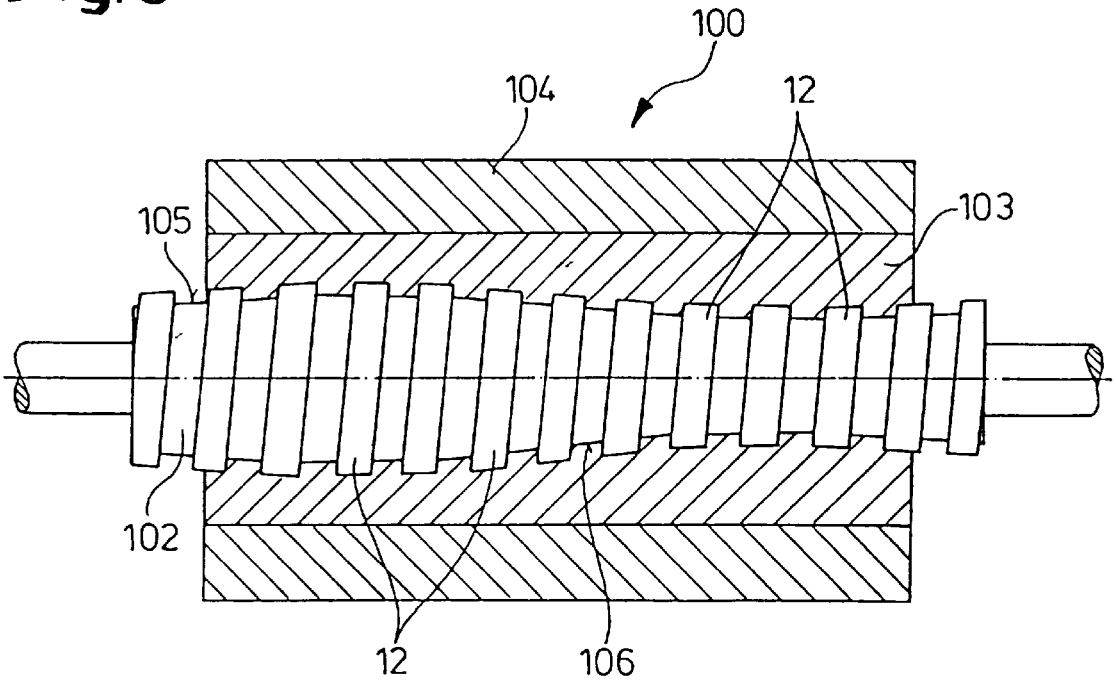
FIG. 6 is a sectional view of a roll in which the contoured surfaces of the roll shaft and the inner roll ring facing each other are in engagement with each other through a thread.

FIGS. 5 and 6 shown an embodiment in which it is possible to transmit between the individual elements of the roll torques which exceed the maximum torque which can be transmitted by frictional engagement alone. In this embodiment, the roll shaft 102 and the roll ring 103 concentrically surrounding the roll shaft 102 are connected to each other by a positive engagement. In a work or support roll 100 which has an outer cylindrical roll ring 104 arranged on the inner roll ring 103, the axial displacement of the surfaces which are not cylindrically contoured is ensured by a thread 12 on the roll shaft, as shown in FIG. 6.

While specific embodiments of the invention have been shown and described in detail to illustrate the inventive principles, it will be understood that the invention may be embodied otherwise without departing from such principles.

We claim:

1. A roll for a roll stand comprising a roll shaft extending in an axial direction, at least one inner roll ring mounted concentrically on the roll shaft, and an outer roll ring concentrically mounted on the at least one inner roll ring, wherein the roll shaft and the at least one inner roll ring are mounted so as to be axially displacable, and wherein at least two of the roll shaft, the at least one inner roll ring and the outer roll ring have surfaces with contours which are curved in the axial direction and turned relative to each other by 180°.

2. The roll according to claim 1, wherein the outer roll ring is mounted so as to be axially displacable.

3. The roll according to claim 1, wherein an outer surface of the roll shaft and an inner surface of the at least one inner roll ring have the curved contours.

4. The roll according to claim 1, wherein an outer surface of the at least one inner roll ring and an inner surface of the outer roll ring have the curved contours.

5. The roll according to claim 1, wherein the roll rings are each composed of a single piece.

6. The roll according to claim 1, wherein the roll rings are composed of multiple pieces.

7. The roll according to claim 1, wherein the outer roll ring has a cylindrical shape, and wherein an inner surface of the at least one inner roll ring has the curved contour.

8. The roll according to claim 1, wherein the surfaces having the curved contours are configured to be positively in engagement with each other.

9. The roll according to claim 8, wherein the surfaces with the curved contours are provided with threads.

* * * * *